US006396771B2

(12) United States Patent
Paratte

(10) Patent No.: US 6,396,771 B2
(45) Date of Patent: May 28, 2002

(54) MEANS FOR RECHARGING A WATCH ACCUMULATOR

(75) Inventor: Daniel Paratte, Neuchâtel (CH)

(73) Assignee: ETA SA Fabriques D' Ebauches, Grenchen (CH)

( * ) Notice: Subject to any disclaimer, the term of this patent is extended or adjusted under 35 U.S.C. 154(b) by 0 days.

(21) Appl. No.: 09/726,113

(22) Filed: Nov. 30, 2000

(30) Foreign Application Priority Data

Dec. 15, 1999 (CH) ..... 2299/99

(51) Int. Cl.[7] ..... G04B 1/00
(52) U.S. Cl. ..... 368/203; 368/204; 368/205
(58) Field of Search ..... 368/203–205, 368/10

(56) References Cited

U.S. PATENT DOCUMENTS 4,321,996 A * 3/1982 Ganter

FOREIGN PATENT DOCUMENTS

CH 681 267 2/1993
DE 10 08 664 5/1957
DE 196 38 953 3/1998

* cited by examiner

*Primary Examiner*—Bernard Roskoski
(74) *Attorney, Agent, or Firm*—Sughrue Mion, PLLC

(57) ABSTRACT

The present invention concerns an electric timepiece, in particular a wristwatch, supplied with electric current by an accumulator (16) intended to be recharged once flat, this timepiece (1) including a time-setting stem (4) and at least one control member (6) for at least one horological function of said timepiece (1), characterised in that the time-setting stem (4) is electrically connected to one of the poles (18) of the accumulator (16), and in that the control member (6) can be electrically connected to the other pole of the accumulator (16) after said member has been pressed.

The present invention also concerns a timepiece of the type-described above, this timepiece (1) including at least a first and a second control member (6') each controlling at least one horological function of said timepiece (1), characterised in that each of the first and second control members (6') can be connected to a respective pole (18, 20) of the accumulator (16) after said member (6') has been pressed.

18 Claims, 7 Drawing Sheets

MEANS FOR RECHARGING A WATCH ACCUMULATOR

The present invention concerns an electric timepiece such as, in particular, a wristwatch, supplied with electric current by an accumulator which is intended to be recharged once flat, and means for recharging the accumulator.

There is known from Swiss Patent No. 345 611 a watch including a recharging terminal passing through the watch case, this terminal being electrically insulated from said case. The end of the terminal situated inside the case is electrically connected to one of the poles of the accumulator intended to supply the watch with electric current, while the end of the terminal situated outside the case is fitted with a removable protective cap, this cap also being electrically insulated from said terminal.

More precisely, the accumulator recharging device disclosed in the aforementioned Patent includes a metal stem passing through a sleeve made of an electrically insulating material, this sleeve itself being housed in a second reinforcing sleeve. This latter sleeve, which is metallic, is driven into the middle part of the watch case. The inner end of the stem is in contact with the top face of the accumulator which forms one of the poles of said accumulator, while the outer end of said stem is pierced with a blind hole intended to accommodate the plug of a recharging apparatus. In normal operating conditions of the watch, the outer end of the stem is protected by a removable cap having the shape of a winding crown.

Recharging of the accumulator can be effected by means of a pocket torch battery. The recharging apparatus includes two metal strips electrically insulated from each other. One of the strips carries a conical plug intended to penetrate the blind hole of the recharging stem described above. The other strip of the recharging apparatus is in contact with the earth of the watch, for example with the time-setting crown. The battery thus recharges the accumulator, one night being generally sufficient for the accumulator to be able to power the movement again for several months.

Such a recharging device advantageously permits the accumulator supplying a watch with electric current to be recharged without it being necessary, in order to proceed with this recharging operation, to open and then close the watch case again in order to be able to remove then replace the accumulator in said case. One can thus recharge the accumulator arranged inside the watch case from the outside of said case.

Such a recharging device has however certain drawbacks from among which one can cite the fact that it is necessary to provide an additional part, in this case a recharging stem, solely intended to allow the watch accumulator to be recharged. This additional part considerably complicates the construction of the watch case which, of course, has a negative impact on the manufacturing costs. The recharging stem which passes through the watch case also has the drawback of altering the sealing or water tightness thereof. Finally, it should also be pointed out that the recharging stem and the time-setting crown by means of which the accumulator is recharged, are in permanent electric contact with said accumulator. Thus, unless complex and expensive arrangements are provided to electrically insulate the recharging stem and the time-setting crown from the rest of the case, there is a risk of the accumulator inadvertently being discharged in the event that the watch becomes wet or simply damp from the perspiration of its wearer.

The object of the present invention is to overcome the above problems and drawbacks in addition to others by proposing a particularly simple and inexpensive system for recharging the accumulator of a watch.

The present invention therefore concerns a timepiece, in particular a wristwatch, supplied with electric current by an accumulator intended to be recharged once flat, this timepiece including a time-setting stem and at least one control member for at least one horological function of said timepiece, characterised in that the time-setting stem is electrically connected to one of the poles of the accumulator, and in that the control member can be electrically connected to the other pole of the accumulator after said member has been pressed.

According to another embodiment, the present invention also concerns a timepiece of the aforementioned type, this timepiece including at least a first and a second control member each controlling at least one horological function of said timepiece, characterised in that each of the first and second control members can be connected to one of the poles of the accumulator after said member has been pressed.

As a result of these features, the watch accumulator can be recharged solely by using the means carried by the watch for adjusting and activating its usual horological functions. It is thus no longer necessary to add additional parts to the watch such as a contact stem or suchlike to be able to connect the accumulator of said watch to a recharging apparatus. The construction of the watch is thus simplified, which substantially limits the manufacturing costs. Likewise, the sealing of the case is not altered.

According to a complementary feature of the invention, the control member or members are push-buttons.

As a result of this other feature, the accumulator charging circuit is only closed when the push-button or push-buttons are pushed in, which avoids any risk of the accumulator being inadvertently discharged when the watch is not placed on the recharging apparatus. It should be noted, on the other hand, that it is very convenient to use the push-buttons as electric contact parts between the accumulator and the charger. These push-buttons may, in fact, be easily insulated from a metal case insofar as they do not engage or mesh with the movement of the watch but act by simple electric contact, for example with a printed circuit contact area, to control the horological functions of said watch.

Other features and advantages of the present invention will appear more clearly upon reading the following detailed description of an embodiment example of a the timepiece according to the invention, this example being given purely by way of illustrative and non limiting example, in conjunction with the annexed drawings, in which.

Figure 1:
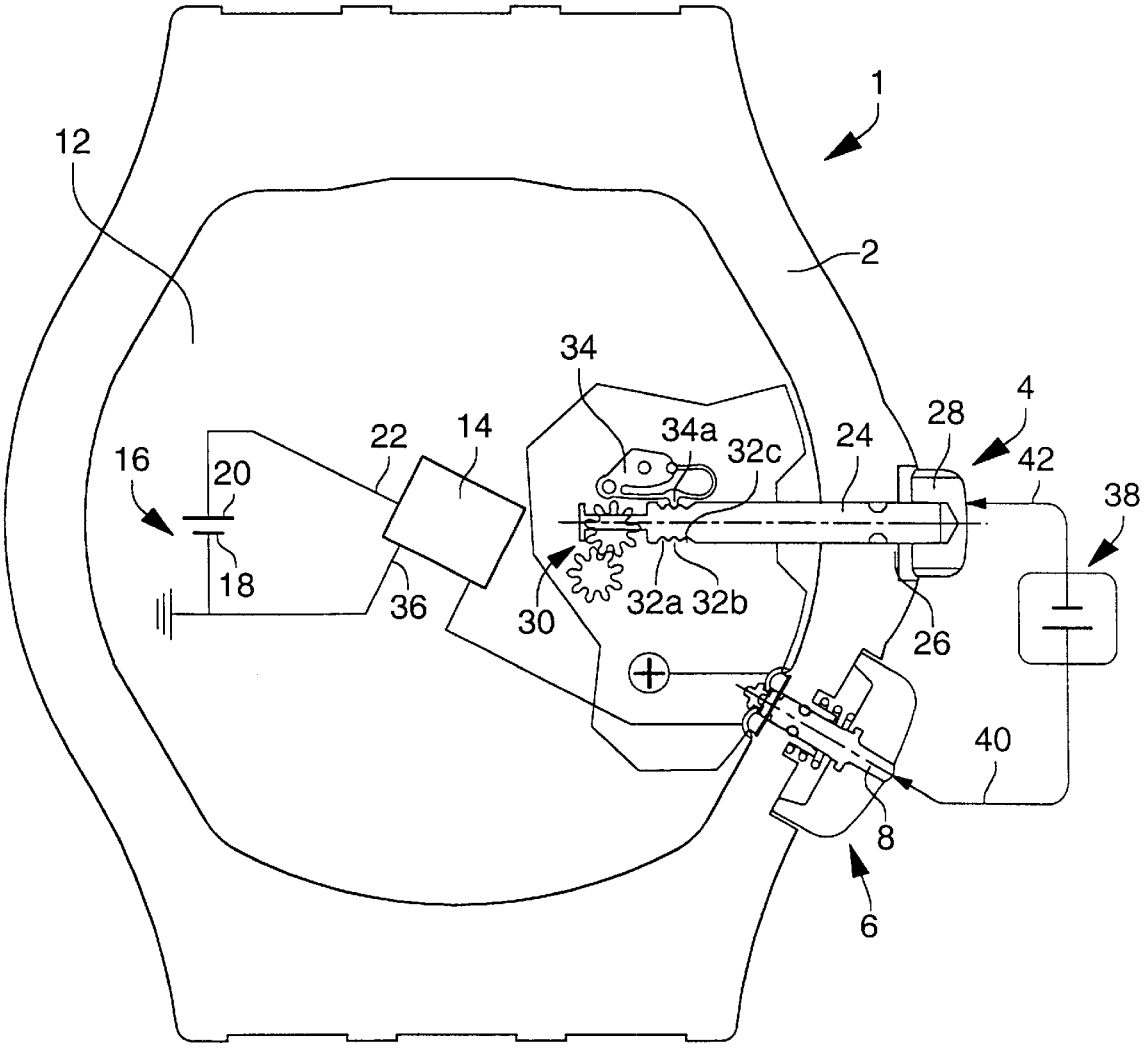
FIG. 1 is a top view of a timepiece according to the invention including a time-setting stem and a push-button.

The present invention proceeds from the general inventive idea which consists in recharging the accumulator of a watch solely by using the means conventionally carried by such a watch for adjusting and activating its usual horological functions.

According to another inventive aspect of the invention, in order to recharge the watch accumulator, a control member of the watch is used, which, in its rest position, is not in electric contact with the terminal of the accumulator to which it is connected, so that any risk of the accumulator being inadvertently discharged in normal operating conditions of the watch is avoided.

The timepiece according to the invention may be, for example, a wristwatch. It is shown schematically in FIG. 1 and designated as a whole by the general reference numeral 1. It includes, in particular, a middle part 2, which may or may not be made of metal, through which passes a time-setting stem 4 and at least one control member 6 controlling at least one horological function of said watch 1. In the example shown in FIG. 1, the control member 6 is of the push-button type. This push-button 6 is principally formed of an elongated metal stem 8 preferably, but not exclusively, having a cylindrical shape. When middle part 2 of the watch is metal, stem 8 of push-button 6 passes through a sleeve 10 made of an electrically insulating material as shown schematically in FIG. 2. This sleeve 10 is driven into middle part 2 of watch 1.

Middle part 2 of watch 1 defines a central cavity occupied, in a conventional manner, by a clockwork movement, display means, such as an hour hand, a minute hand and a second hand moving above a dial, as well as other elements, such as, in particular, a printed circuit 12 on which is mounted an electronic control module 14 which controls the operation of the clockwork movement of said watch 1.

Electronic control module 14 is supplied with current by an accumulator 16 intended to be recharged once flat. Accumulator 16, shown schematically in FIG. 1, typically has the shape of a disc or button. It may be housed in the back cover of watch 1. The bottom face of accumulator 16 which constitutes its negative pole 18 is electrically connected to the metal back cover and thus to metal middle part 2, i.e. to the earth of watch 1, for example via a contact spring secured to the inner surface of the back cover of said watch 1. The positive pole 20 of accumulator 16 which is constituted by its top face is connected, in a conventional manner, to the positive input terminal 22 of electronic control circuit 14 which forms the second supply conductor of the movement of watch 1.

It goes without saying that the watch, in particular the back cover and middle part thereof, may be made of an electrically insulating material such as a plastic material. In such case, only one of the poles of accumulator 16 needs to be connected by an electric connection to time-setting stem 4, the other pole of said accumulator 16 remaining connected to input terminal 22 of control circuit 14.

It also goes without saying that the poles of accumulator 16 may be inverted, the bottom face of the round battery forming its positive pole 20, and the negative pole 18 then being located above the battery. In such case, positive pole 20 is electrically connected to the earth of watch 1.

As shown in FIG. 1, time-setting stem 4 essentially includes a control rod 24 penetrating a lateral opening 26 of middle part 2 which guides rod 24 in translation and in rotation. Lateral opening 26 is oriented conventionally along a horizontal 3 o'clock-9 o'clock axis. Control rod 24 first includes a winding crown 28 so that the user of watch 1 can manoeuvre rod 24 in translation and in rotation.

It then includes at its free end oriented towards the center of watch 1, a pinion which co-operates conventionally with a toothed intermediate wheel (not shown). The mechanism can thus mesh with toothed wheels 30 which are, for example, the wheel for correcting the date and possible the day of the week and the time correcting wheel. Rod 24 further includes three grooves 32*a*, 32*b* and 32*c* which co-operate with one end 34*a* of a spring 34 to define three axial positions of said rod 24. In FIG. 1, end 34*a* of spring 34 is meshed with groove 32*b* to define the position of the mechanism in which date correction wheel 30 is driven. When the user brings control rod 24 into this position and rotates it, the rotation of the pinion mounted at the end of said rod 24 causes the corresponding wheel 30 to rotate thus allowing, for example, the date to be corrected. Likewise, when the control rod is completely pushed in, this corresponds to the neutral position in which rod 24 can be rotated without acting on wheels 30. Rod 24 is held in this position because end 34*a* of spring 34 is engaged in groove 32*a*. Finally, rod 24 can be brought into its second active position in which end 34*a* of spring 34 is engaged in groove 32*c*. In this third position, the rotation of control rod 24 causes the corresponding wheel 30 to rotate to correct the time.

It can be seen in FIG. 1 that positive pole 20 and negative pole 18 of accumulator 16 are respectively connected to positive input terminal 22 and negative input terminal 36 of electronic control circuit 14. It can also be seen in FIG. 1 that push-button 6 is electrically connected to positive pole 20 of accumulator 16, while time-setting stem 4 is connected to the earth of watch 1, i.e. to negative pole 18 of said accumulator 16. It is thus possible, as will be seen in detail hereinafter, to recharge accumulator 16 from the exterior of watch 1 by means of a recharging apparatus 38 whose electric plugs 40 and 42 will be accommodated by push-button 6 and time-setting stem 4 respectively.

Figure 2:
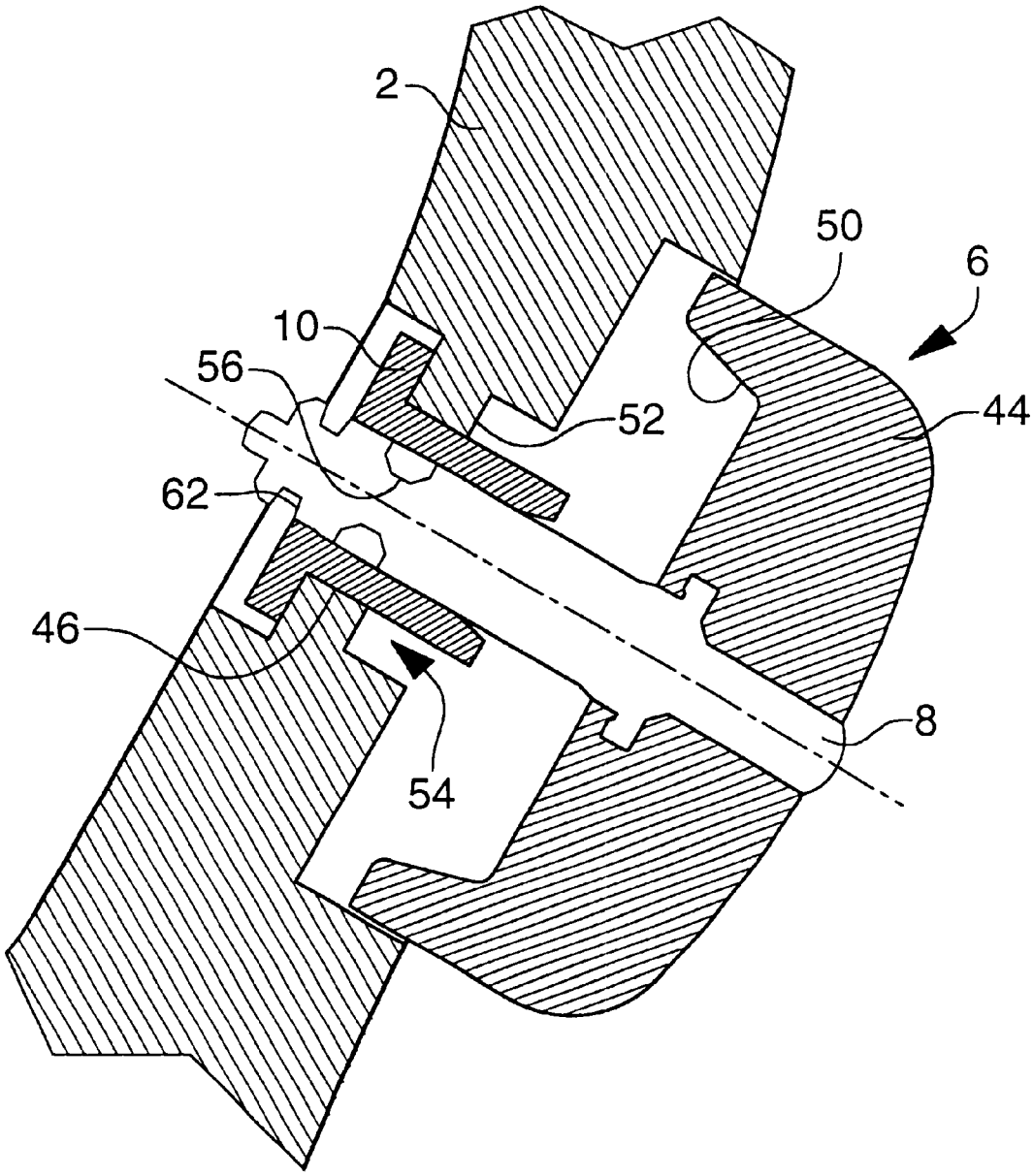
FIG. 2 is a detailed view on a larger scale of the push-button of FIG. 1.
Figure 3:
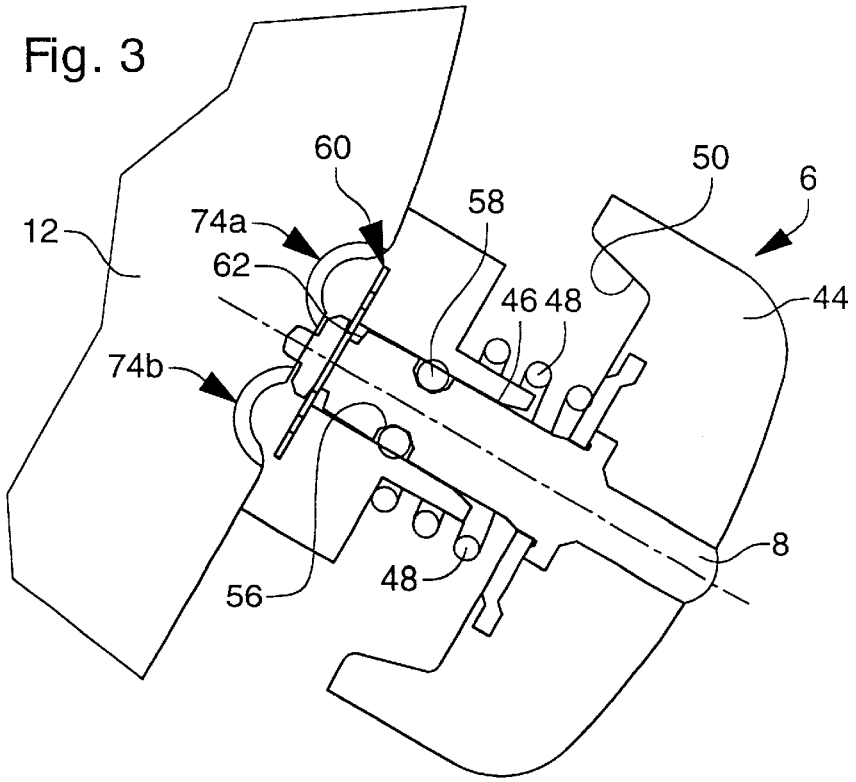
FIG. 3 is a top view of a push-button.
Figure 4:
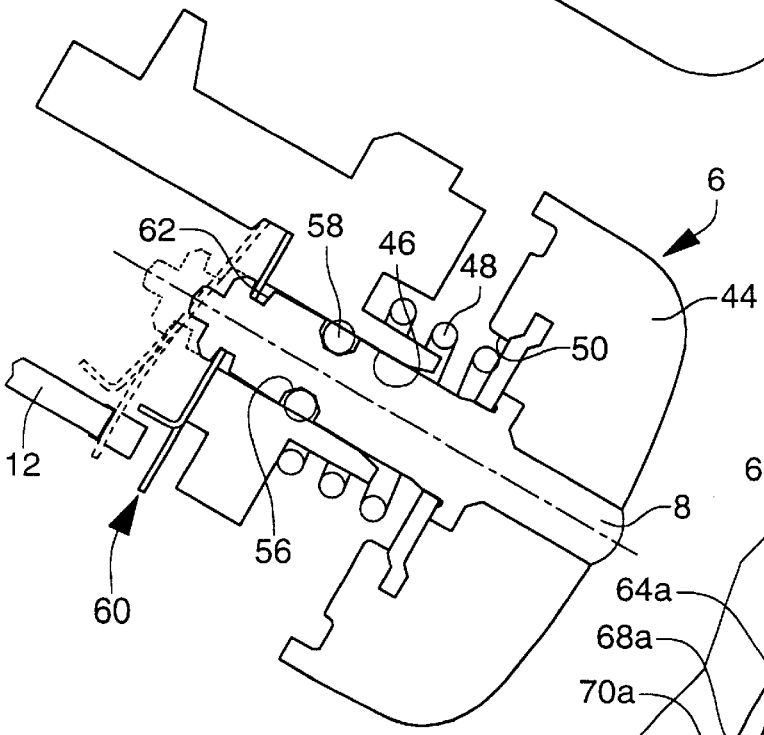
FIG. 4 is a cross-section of a push-button of FIG. 3.
Figure 6:
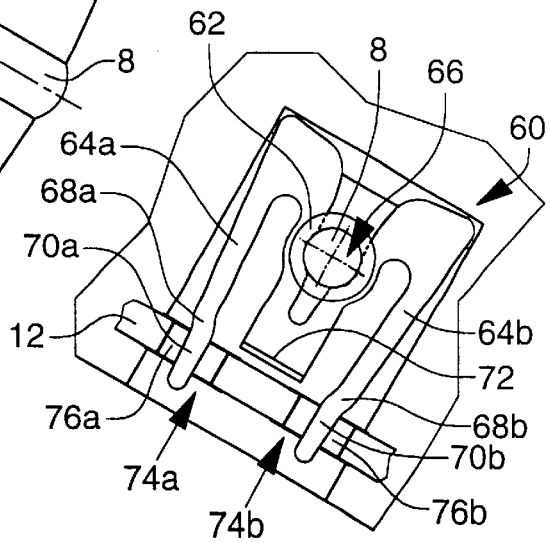
FIG. 6 is a face view of the key of FIG. 5.

As shown more particularly in FIGS. 2 to 4, push-button 6 includes a pusher head 44 and the metal pusher stem 8. Pusher stem 8 is arranged so as to slide inside a housing 46 of generally cylindrical shape arranged in middle part 2 of watch 1. Pusher stem 8 moves axially in housing 46 against the return force of a spring 48 when a control push is applied onto the pusher head 44.

The return spring 48 is arranged in a housing 50 arranged in pusher head 44 and rests axially on the bottom 52 of a cavity 54 provided in middle part 2. Pusher stem 8 has at one location on its length an annular groove 56 in which a sealing gasket 58 is housed. This gasket 58 assures the water-resistant sealing of housing 46 when stem 8 slides into it when push-button 6 is activated by a user.

Push-button 6 also includes retaining means 60 which exert sufficient force on pusher stem 8 to act against the return force of spring 48 and thus to prevent said stem 8 from escaping from housing 46 in which it slides. Retaining means 60 are a W-shaped key which is engaged in an annular groove 62 of pusher stem 8 towards its end opposite pusher head 44. In normal conditions of use, key 60 is thus always pressed against the inner face of middle part 2 of watch 1. It only moves when a control push is applied onto push-button 6.

Figure 5:
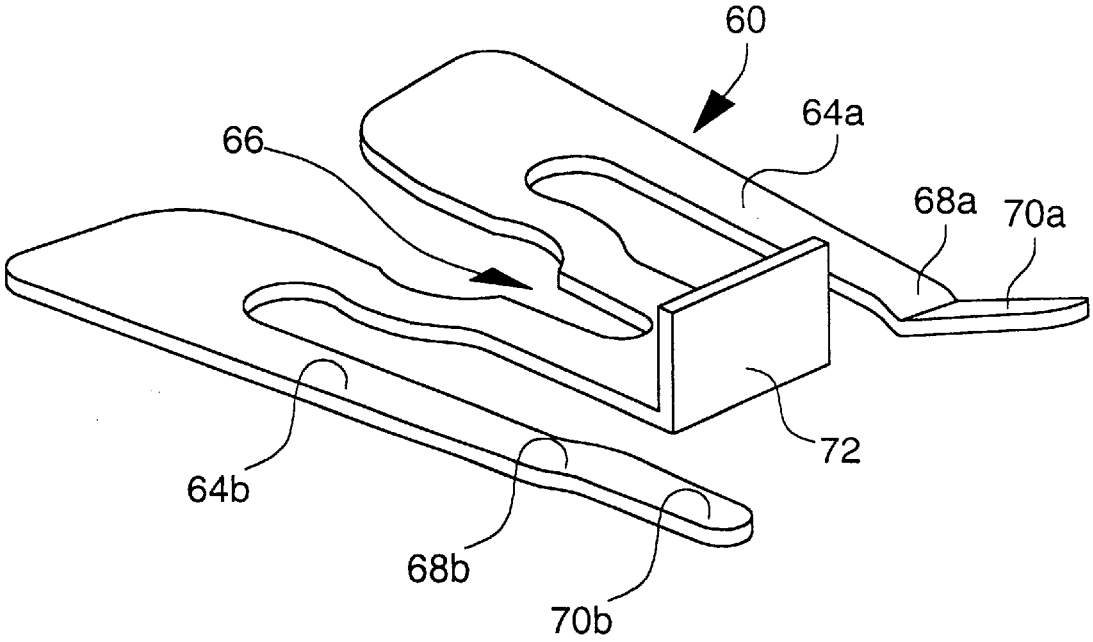
FIG. 5 is a blown up perspective view of a key mounted on the stem of a push-button.

Key 60 is obtained by cutting out or stamping a metal sheet along a particular contour and bending it so that, after being set in place, it performs both the function of key and contact means. Key 60 is thus formed of two strips 64*a* and 64*b* extending in the general plane of said key 60. These two strips 64*a*, 64*b* are connected to each other in their top part by a V-shaped notch 66 intended to engage in annular groove 62 of pusher stem 8 to form a key. Towards the bottom, each of strips 64*a*, 64*b* is extended beyond a bent portion 68*a*, 68*b* by a small bent contact lug 70*a*, 70*b*. FIG. 5 shows clearly that contact lug 70*a* is projected at a certain angle outside the general plane of key 60 to establish a contact, for example an earth contact, over a zone of printed circuit 12 as will be seen hereinafter. Finally, notch 66 is extended by a tongue 72 bent at substantially 90° with respect to the plane of key 60.

Printed circuit 12 on which electronic control circuit 14 is mounted, includes two contact pads 74*a*, 74*b* which are each formed of a semi-cylindrical hole having a metallised vertical wall 76*a*, 76*b* arranged facing respective contact lugs 70*a*, 70*b* of key 60. One of these holes is electrically connected to control module 14, while the other hole is connected to positive pole 20 of the accumulator.

When a control push is exerted on push-button 6, key 60 moves and its contact lugs 70*a*, 70*b* touch metallised holes 74*a*, 74*b*. As described above, contact lug 70*a*projects outside the general plane of key 60. Thus, when push-button 6 is pushed in, this contact lug 70*a* comes into contact with metallised hole 74*a* which faces it before the other contact lug 70*b* itself touches the metallised hole 74*b* which corresponds to it, which allows electrostatic discharges, which are particularly damaging to electronic control circuit 14, to be avoided.

When the two contact lugs 70*a*, 70*b* touch the metallised holes, there is a short-circuit between these two holes 74*a*, 74*b* which causes an item of data to arrive at electronic control module 14. When watch 1 according to the invention is placed on the recharging apparatus, push-button 6 remains pushed in for a relatively long period of time. Control circuit 14 is programmed so that it understands when this situation does not correspond to the introduction of a control instruction for a horological function of watch 1, but to charging accumulator 16.

Tongue 72 which extends notch 66 at 90° with respect to the plane of key 60 abuts onto printed circuit 12 in the event that key 60 leaves annular groove 62 of pusher stem 8 in which it is engaged. Key 60 is thus not likely to fall into the clockwork movement of the watch which it could damage.

As already described hereinbefore, push-button 6 is electrically connected to positive pole 20 of accumulator 16, while time-setting stem 4 is connected to the earth of watch 1, i.e. to negative pole 18 of said accumulator 16. In order to recharge accumulator 16 of watch 1, the latter is placed on recharging apparatus 38. Electric plugs 40 and 42 of recharging apparatus 38 are then accommodated by push-button 6 and time-setting stem 4 respectively. Electric plug 42 which comes into contact with time-setting stem 4 may be formed of a simple metal strip. When watch 1 is placed on recharging apparatus 38, push-button 6 is pushed into its active position in which electric contact is established between positive pole 20 of accumulator 16 and electric plug 40 of recharging apparatus 38.

According to a first alternative embodiment, push-button 6 includes a metal pusher head 44 driven onto pusher stem 8. It must then be ensured that this metal pusher head 44 does not cause short-circuits with its surroundings.

Figure 7:
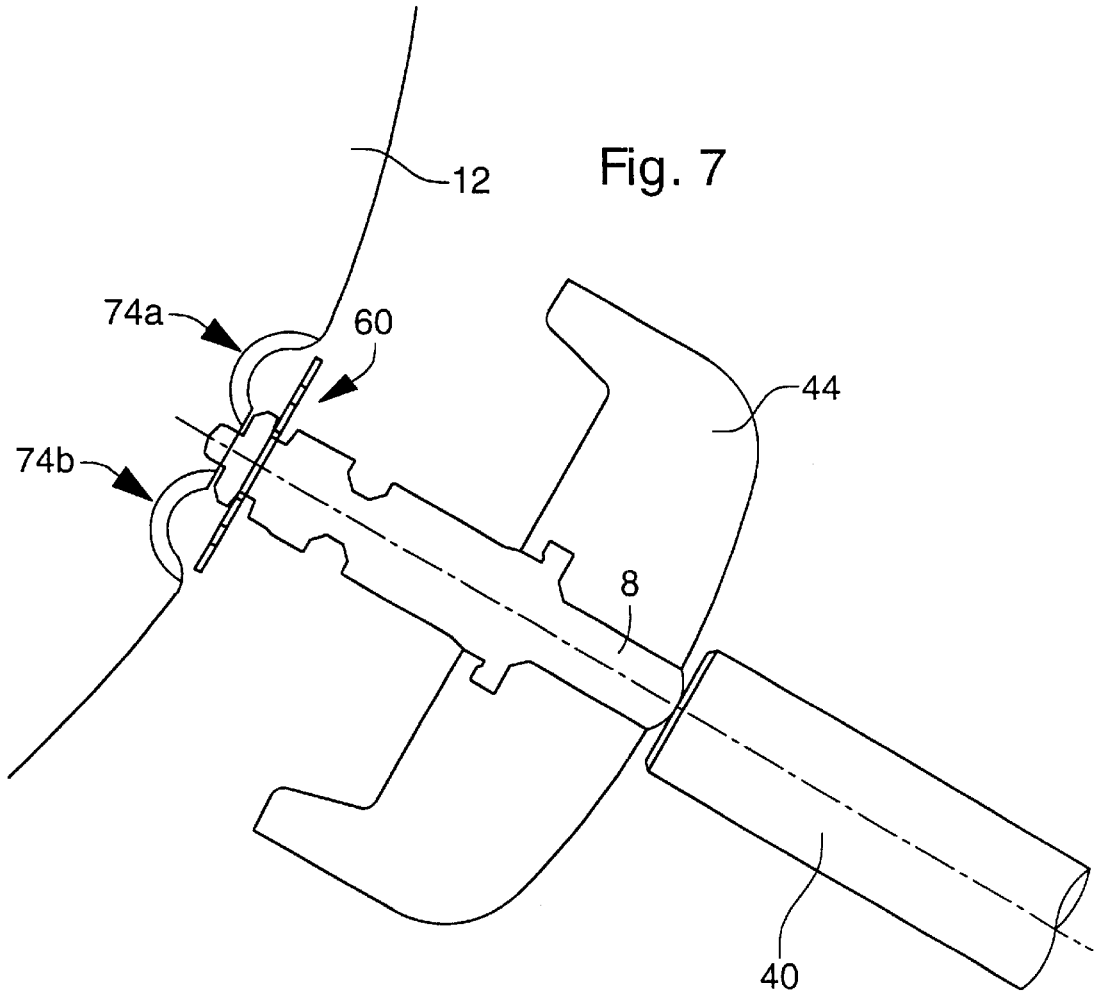
FIG. 7 is a cross-section of a first alternative embodiment of a push-button.

According to a second alternative embodiment shown in FIG. 7, pusher head 44 is made of a plastic or elastomeric material by injection moulding so as to connect itself to pusher stem 8. As FIG. 7 shows, metal pusher stem 8 is flush with pusher head 44 or projects slightly from the surface of said pusher head 44, so that the electric contact can be established with electric plug 40 of recharging apparatus 38.

Figure 8:
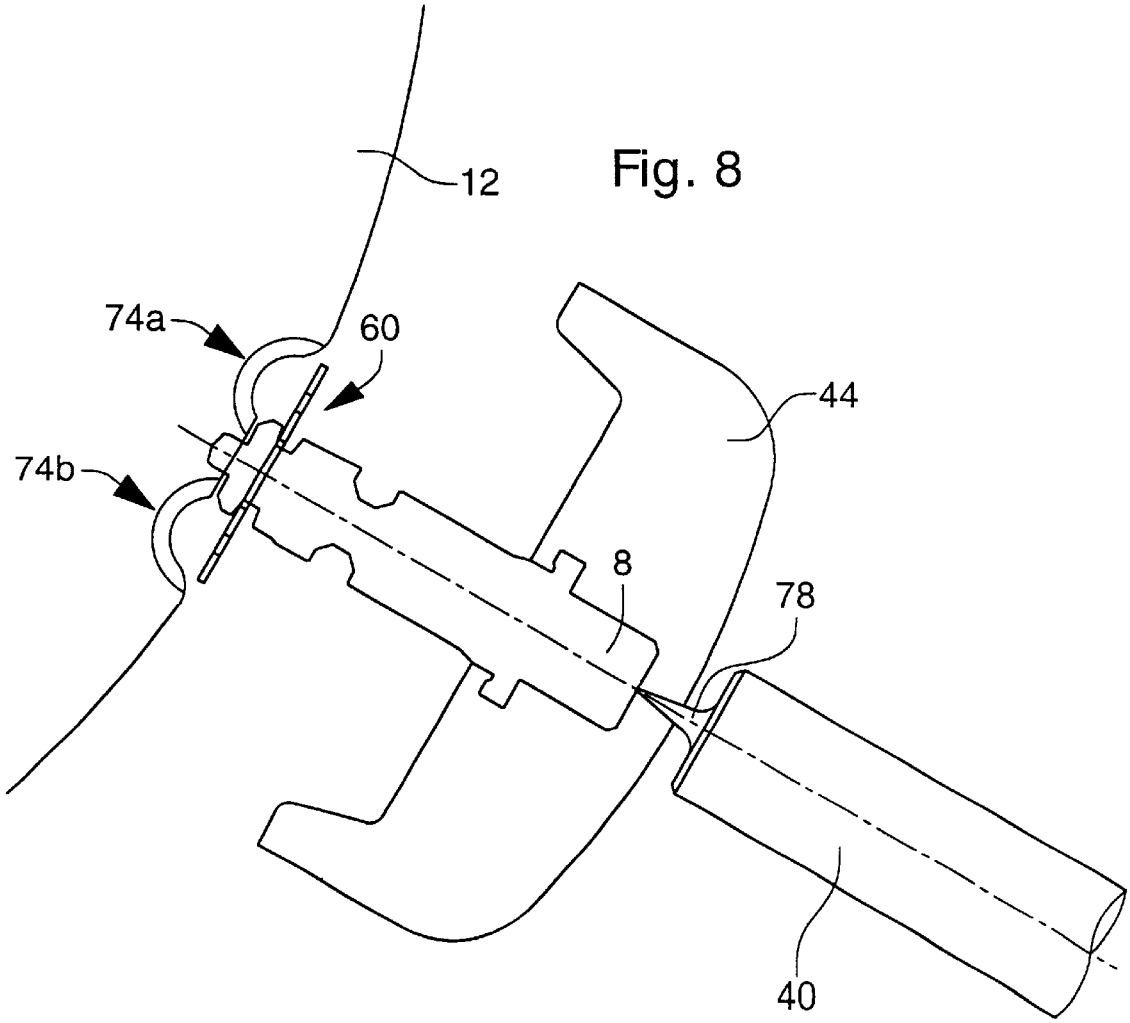
FIG. 8 is a cross-section of a second alternative embodiment of a push-button.

According to another variant shown in FIG. 8, pusher stem 8 is embedded in pusher head 44 which is made of a relatively soft plastic material or elastomer. Electric plug 40 of recharging apparatus 38 thus has an extremely tapered point 78 which his capable of easily penetrating the soft material of which pusher head 44 is made and to come into electric contact with pusher stem 8.

In the following description, those parts which are identical or similar to the parts already described with respect to the first embodiment are indicated with the same reference numeral, but with an added apostrophe.

Figure 9:
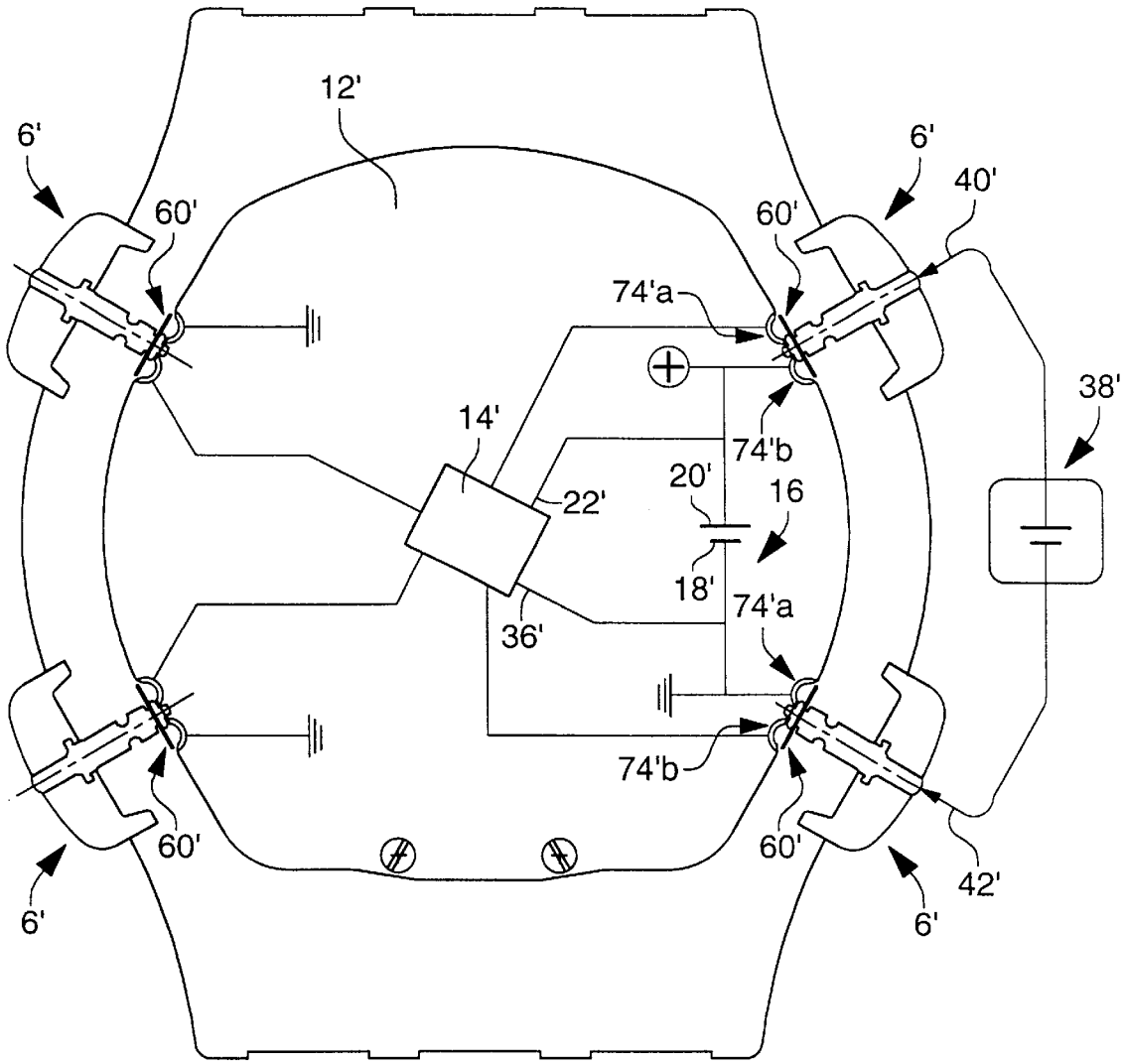
FIG. 9 is a top view of a timepiece according to the invention including four push-buttons.

Timepiece 1 according to the invention may include at least two control members each controlling at least one horological function of said timepiece. In the example shown in FIG. 9, these control members are formed by four push-buttons 6' of the type described above. These four push-buttons 6' each include in particular retaining means 60' cut out and bent so as to exert, after being set in place, both the function of key and contact means. Retaining means 60' are keys facing which is provided, each time, a pair of contact areas 74'*a*, 74'*b* formed on printed circuit 12'.

These contact areas 74'*a*, 74'*b* are each formed of a semi-cylindrical hole having a metallised vertical wall 76'*a*, 76'*b*.

According to the invention, one hole of each pair of contact areas 74'*a*, 74'*b* is electrically connected to electronic control module 14', whereas the other hole is connected to the earth of watch 1, i.e. to negative pole 18' of accumulator 16'. The same is true for the other pairs of holes 74'*a*, 74'*b* except for one pair whose hole will be connected to positive pole 20' of accumulator 16'. Thus, one of push-buttons 6', in this case the one located at the top and to the right of FIG. 9, will be connected to positive pole 20' of accumulator 16', whereas the other three push-buttons 6' will be connected to the negative pole 18' of said accumulator 16'. Thus, when pressure is simultaneously applied on two push-buttons 6' connected to opposite poles of accumulator 16', recharging apparatus 38' is connected to the terminals of said accumulator 16' via the respective pusher stems 8' of these two push-buttons 6'.

It goes without saying that various variants and simple modifications fall within the scope of the present invention.

What is claimed is:

1. An electric timepiece, in particular a wristwatch, supplied with electric current by an accumulator intended to be recharged once flat, this timepiece including a time-setting stem and at least one control member for at least one horological function of said timepiece, wherein the time-setting stem is electrically connected to one of the poles of the accumulator, and in that the control member can be electrically connected to the other pole of the accumulator after said member has been pressed.

2. A timepiece according to claim 1, wherein the time-setting stem includes a control rod winding crown, the rod further including three grooves which co-operate with one end of a spring to define three axial positions of said rod.

3. The timepiece according to claim 1, wherein the control member is a push-button.

4. A timepiece, in particular a wristwatch, supplied with electric current by an accumulator intended to be recharged once flat, this timepiece including at least a first and a second control member each controlling at least one horological function of said timepiece, wherein each of the first and second control members can be connected to a respective pole of the accumulator after said member has been pressed.

5. A timepiece according to claim 4, wherein it includes a third control member which can be connected to one of the poles of the accumulator after said member has been pressed.

6. A timepiece according to claim 4, wherein the control members are push-buttons.

7. A timepiece according to claim 6, wherein the push-button or push-buttons each include retaining means which exert both the function of key and of contact means.

8. A timepiece according to claim 7, wherein the retaining means are a W-shaped key.

9. A timepiece according to claim 8, wherein the key includes two strips extending in the general plane of the key, these two strips being connected to each other in their top portion by a V-shaped notch and each being extended towards the bottom, beyond a bent portion, by a bent contact lug.

10. A timepiece according to claim 9, wherein one of the contact lugs projects at an angle outside the general plane of the key.

11. A timepiece according to claim 9, wherein the notch is extended by a tongue bent at substantially 90° with respect to the plane of the key.

12. A timepiece according to claim 6, wherein the push-button includes a pusher head and a metal pusher stem.

13. A timepiece according to claim 12, wherein the pusher head is metallic and is driven onto the pusher stem.

14. A timepiece according to claim 12, wherein the pusher head is made of a plastic or elastomeric material and in that the pusher head is flush with the pusher head projects slightly from said pusher head.

15. A timepiece according to claim 12, wherein the pusher stem is embedded in the pusher head which is made of a relatively soft plastic or elastomeric material and in that one of the electric plugs of the recharging apparatus intended to recharge the accumulator has a tapered point which is capable of penetrating the soft material of which the pusher head is made and of coming into contact with the pusher stem.

16. A timepiece according to claim 12, wherein the pusher stem is arranged so as to slide inside a housing arranged in the middle part of said timepiece, and in that a return spring is disposed in a housing arranged in the pusher head and rests axially on the bottom provided in said middlepart.

17. A timepiece according to claim 8, wherein it includes a printed circuit which has two contact areas disposed respectively facing the contact lugs of the key.

18. A timepiece according to claim 17, wherein the contact areas are each formed of a half cylindrical hole which has a vertical metal wall, one of these holes being connected to an electronic control module of said timepiece, and the other hole being connected to one of the poles of the accumulator.

* * * * *